United States Patent [19]

Cytron

[11] Patent Number: 4,562,951

[45] Date of Patent: Jan. 7, 1986

[54] METHOD OF MAKING METALLIC GLASS-METAL MATRIX COMPOSITES

[75] Inventor: Sheldon J. Cytron, Mountain Lakes, N.J.

[73] Assignee: The United States of America as represented by the Secretary of the Army, Washington, D.C.

[21] Appl. No.: 591,295

[22] Filed: Mar. 19, 1984

Related U.S. Application Data

[63] Continuation of Ser. No. 367,693, Apr. 12, 1982, abandoned.

[51] Int. Cl.[4] ..... B23K 31/02

[52] U.S. Cl. ..... 228/234; 29/419 R; 148/403; 228/238; 228/263.17; 428/652

[58] Field of Search ..... 29/419; 228/265, 263.17, 228/263.14, 263 R, 263.11, 234, 238; 148/403; 428/652, 651; 420/441

[56] References Cited

U.S. PATENT DOCUMENTS

| | | | |
|---|---|---|---|
| 3,711,936 | 1/1973 | Athey et al. | 29/419 |
| 3,862,484 | 1/1975 | Chivinsky | 228/223 X |
| 3,993,238 | 11/1976 | Brook et al. | 228/234 X |
| 4,209,570 | 6/1980 | DeCristofaro et al. | 228/263 |
| 4,255,189 | 3/1981 | Ray | 148/403 X |

*Primary Examiner*—Howard N. Goldberg
*Assistant Examiner*—Joseph M. Gorski
*Attorney, Agent, or Firm*—Anthony T. Lane; Robert P. Gibson; Edward F. Costigan

[57] ABSTRACT

A novel method is provided for producing metallic glass reinforced metal matrix composites possessing good interfacial bonding between the metallic glass and the metal matrix without gross degradation of the metallic glass or metal matrix. A layer of metallic glass in suitable form, e.g. ribbon, wire or flake, is placed between layers, e.g. sheets, of metal matrix material, which exhibits superplastic flow at a temperature below the crystallization temperature of the metallic glass material. The resulting structure is compressed at a temperature below the crystallization temperature of the metallic glass and sufficient to produce extensive superplastic flow of the metal matrix material.

1 Claim, 1 Drawing Figure

METHOD OF MAKING METALLIC GLASS-METAL MATRIX COMPOSITES

GOVERNMENT RIGHTS

The invention described herein may be manufactured, used, and licensed by or for the Government for Governmental purposes without the payment to me of any royalties thereon.

This application is a continuation of application Ser. No. 367,693, filed Apr. 12, 1982, now abandoned.

BACKGROUND OF THE INVENTION

The present invention relates to a novel method for incorporating metallic glass ribbons, flakes, etc. as reinforcements into metal matrix composites. Metallic glasses represents a class of materials of increasing importance in view of their extraordinary mechanical properties, e.g. strength, low cost and availability in a wide variety of alloy systems. They are primarily solid amorphous materials which can be obtained directly from the molten condition by rapid liquid quenching techniques, as illustrated in U.S. Pat. No. 4,059,441 and references cited therein.

In the past, metallic glass ribbons have been incorporated into composite structures using organic matrix material. The incorporation of metallic glass ribbons as reinforcements into composite structures using metal matrix material can provide properties not possible from an organic matrix composite. Thus, for example, high strength metallic glass ribbons having a crystallization temperature above 800° C. have been utilized to reinforce a metal matrix such as an aluminum alloy melting well below said temperature, by heating the composite in an oven at about 600° C. to melt the aluminum alloy, and then cooling to room temperature. While such a procedure maintains the structure and properties of the metallic glass reinforcement ribbons, it can adversely affect the crystal structure and physical properties of the metallic matrix.

SUMMARY OF THE INVENTION

An important requirement of metallic glass-metal matrix composites is that they possess a good bond between the metallic glass and the metal matrix. Also, it is important that the consolidation conditions, e.g. temperature, of such composites be selected so as to void degrading either the metallic glass ribbon or the metal matrix.

The present invention provides a novel method for producing such composites, which are characterized by good interfacial bonding between the metallic glass and the metal matrix, without degradation of either the metallic glass reinforcement material or the metal matrix material. The novel method comprises consolidating metallic glass ribbons, flakes, etc. into a metal matrix composite, e.g. laminate, by utilizing a metal matrix material which exhibits superplastic deformation at a temperature below its melting point and below the critical crystallization temperature of the metallic glass material used. The consolidation is accomplished under elevated pressure and at a temperature which is below the critical crystallization temperature of the metallic glass but sufficient to permit thermoplastic flow of the metal matrix material under the elevated pressure conditions employed. In this manner degradation of the metallic glass and metallic matrix material is avoided and good bonding is achieved by the superplastic forming of the metal matrix during the consolidation at elevated temperatures and pressure.

DETAILED DESCRIPTION OF THE INVENTION

Figure 1:
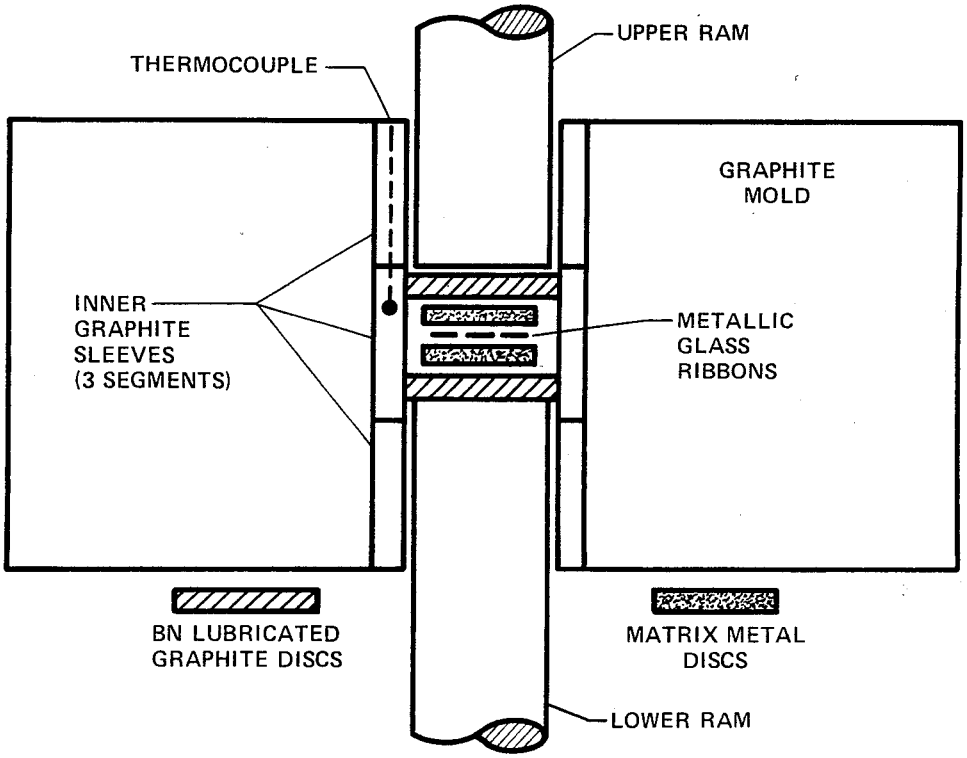
FIG. 1 is a plan view of a vacuum hot press assembly for making a metallic glass-metal matrix composite according to the process of the present invention.

The following example describes the consolidation of $Ni_{60}Nb_{40}$ metallic glass ribbons as reinforcement ribbon in an aluminum alloy matrix. The $Ni_{60}Nb_{40}$ ($T_c$) of 650° C. (B. C. Geissin, Mr. Madhava and D. E. Polk, Mater. Sci. Eng. 23, 145 (1976). The melt spun metallic glass ribbon revealed the usual amorphous rings as shown by X-ray diffraction patterns. The metallic glass ribbon was approximately 0.1 cm. wide and approximately 50 microns thick and was cut into approximately 1 cm long strips, which are given an ultrasonic wash in ethyl alcohol before being placed in the press.

The aluminum alloy matrix was manufactured by Alcan Ltd. and had the composition 90 Al-5 Zn(wt.%). The alloy becomes superplastic at a temperature range of 450°-500° C. (which is well below the crystallization temperature of 650° C. possessed by the $Ni_{60}Nb_{40}$ metallic glass ribbon used) and requires minimal pressure to induce plastic flow. Further information regarding microstructure, metallurgy, and mechanical properties of this alloy is disclosed in Mater. Sci. Eng. 43, 85 (1980). The alloy was obtained as a cold rolled sheet 2.3 mm thick. Discs 2.2 cm in diameter were punched from the sheet, give an abrasive finish with 600 grit silicon carbide paper and ultrasonically washed in ethyl alcohol prior to placement in the press.

A single layer of the metallic glass strips was placed between two of the aluminum alloy matrix discs. The stack thus obtained was placed in a 2.54 cm diameter cavity of a conventional hot vacuum press shown in FIG. 1, and subjected to a small sustained pressure. The press was evacuated to approximately $10^{-3}$ Torr., and the graphite die assembly was slowly heated to 450°-500° C., during which the ram travel and die temperature were continuously monitored. Compression of the stack was initiated when the beginning of superplastic flow was detected. The stack was fully compressed by application of a final pressure of 17 Mpa (2,500 psi), care being taken to avoid extruding material past the boron nitride (BN) lubricated face discs.

A radiograph of the resulting compressed composite showed no evidence of fragmentation of the metallic glass reinforcement strips therein.

To evaluate the bond strength between the metal glass strip and the matrix alloy, a narrow sectioned portion of the composite was bent 180°. A macrograph of the bent specimen showed no evidence of separation at the metallic glass-metal matrix interface. Where cracks in the metallic glass occureed in the bent specimen, the interfacial adhesion was still strong enough to prevent any debonding. X-ray diffraction patterns obtained from metallic glass strips chemically separated from the compressed composite showed only an amorphous ring pattern very similar to the X-ray pattern of the initial metallic glass ribbon.

The foregoing results show that composites having good bonding between the metallic glass reinforcement material and the metal matrix can be obtained without gross degradation of the metallic glass material or the metal matrix according to the method of the present invention by employing a metal matrix material exhibiting superplasticity, and compressing the composite at a temperature which is below the crystallization temperature of the metallic glass (to maintain the amorphous structure and associated mechanical properties, e.g. strength, thereof) and sufficient to insure extensive superplastic flow without melting of metal matrix material. It has been found that good solid state bonding of metal matrix alloy to metallic glass reinforcement ribbon etc. is achieved by utilizing the superplastic property of the metal matrix alloy according to the process of the present invention. Superplasticity (or anomalous ductility) of metals and alloys is well known in the art and is discussed and illustrated by J. Edington et al. in Prog. Materials Science, 21, 61 (1976).

In place of the 90 Al-5 Ca-5 Zn alloy matrix employed in the example described above, the process of the present invention can be carried out by utilizing any metal matrix material exhibiting superplastic flow at a temperature below, preferably at least about 100° C. below, the critical crystallization temperature of the metallic glass material employed therewith, and effecting the consolidation under a pressure and at a temperature substantially below, and preferably at least about 100° C. below the critical crystallization temperature of the metallic glass material. The superplastic flow temperature is synonymous with the Test Temperature noted in the aforesaid article by J. Edington. Metal materials which exhibit superplastic flow (superplasticity) are well known and many specific examples thereof are disclosed in the aforementioned article, which is incorporated herein by reference. The following metal matrix materials with superplastic properties are particularly important for producing composites with a suitably selected metallic glass ribbon according to the process of the present invention:

(1) Aluminum alloys, particularly 7475 aluminum alloy having the composition % by weight: Zn 6, Mg 2, Cu 1.2, Cr 0.2, Fe 0.12 max., Si 0.1 max, Mn 0.06 max, balance Al.

(2) Ultrahigh carbon (UHC) steels containing between 1 and 2.1% C (USP 3951967), and (3) Uranium-molybdenum alloys, particularly U-1.5 Mo. alloy.

In place of the $Ni_{60}Nb_{40}$ metallic glass ribbon used in the above example, any metallic glass reinforcement material can be employed provided it possesses a crystallization temperature above the temperature used for thermoforming the metal matrix material utilized therewith to prepare the composite according to the process of the present invention. The metallic glass is employed in any suitable configuration, such as ribbon, wire and strip, as reinforcement material in the composition of the present invention. While the metal matrix is preferably employed in sheet form, it can also be employed in powder form with good results. For example, a satisfactory composite was obtained by compacting $Ni_{60}Nb_{40}$ metallic glass strips (Tc 650° C.) with an aluminum alloy powder (composition 8% Zn, 2.4% Mg, 1.5% Co, 1% Cn, balance Al) which exhibits superplastic flow at a temperature range of 450°–525° C. Further, the consolidation of the metallic glass-metal matrix composite under elevated pressure and temperature can be accomplished in a vacuum hot press, hot isotatic press, extrusion press, hot roller mill or other suitable manner or means.

The foregoining disclosure and drawings are merely illustrative of the principles of this invention and are not to be interpreted in a limiting sense. I wish it to be understood that I do not desire to be limited to the exact details of construction shown and described because obvious modifications will occur to a person skilled in the art.

What is claimed is:

1. In an improved process of making composites of metallic matrices with a metallic glass reinforcement therebetween, the improvement consisting of dispersing a layer of $Ni_{60}Nb_{40}$ glass reinforcement between layers of metallic matrices to form a structure, heating the structure to a temperature between 450° C. and 500° C., and compressing the structure at 2500 psi to bond the layer of galls reinforcement to the metallic matrices in order to form a composite with said glass reinforcement therebetween, wherein each metallic matrix is composed of 90% Al by weight, 5% Ca by weight and 5% Zn by weight.

* * * * *